United States Patent [19]

Bard, et al

[11] 4,371,499

[45] Feb. 1, 1983

[54] CONTROL OF A FLUID CATALYTIC CRACKING UNIT

[75] Inventor: William B. Bard; John O. Walters, both of Bartlesville, Okla.

[73] Assignee: Phillips Petroleum Company, Bartlesville, Okla.

[21] Appl. No.: 258,974

[22] Filed: Apr. 30, 1981

[51] Int. Cl.[3] ..... C10G 11/18; G05D 7/00; F27B 15/00

[52] U.S. Cl. ..... 422/111; 208/113; 208/DIG. 1; 364/500; 364/501; 422/144; 422/178; 422/190

[58] Field of Search ..... 422/111, 177, 178, 144, 422/190; 364/500, 501; 208/113, DIG. 1

[56] References Cited

U.S. PATENT DOCUMENTS

| | | | |
|---|---|---|---|
| 3,175,968 | 3/1965 | Berger | 208/164 |
| 3,591,783 | 7/1971 | Zumwalt | 208/164 |
| 3,687,841 | 8/1972 | Saxon et al. | 208/164 |
| 3,689,403 | 9/1972 | Long | 422/111 |
| 3,707,463 | 12/1972 | Harter et al. | 422/144 |
| 3,795,485 | 3/1974 | Bogart | 422/190 |
| 3,824,388 | 7/1974 | Cugini | 364/101 |
| 4,164,451 | 8/1979 | Funk | 364/501 X |
| 4,164,452 | 8/1979 | Funk et al. | 364/501 X |
| 4,345,993 | 8/1982 | Stewart | 422/111 |

*Primary Examiner*—Arthur D. Kellogg

[57] ABSTRACT

A control system for a fluid catalytic cracking unit is provided in which either the wet gas compressor or the air blower is selected for base loading. After the device selected for base loading has been base loaded, load is shifted to the device which was not base loaded. The feed flow rate is forced to continue to increase until both the wet gas compressor and the air blower are loaded so as to substantially maximize the production of the desired product.

20 Claims, 2 Drawing Figures

CONTROL OF A FLUID CATALYTIC CRACKING UNIT

Figure 1:
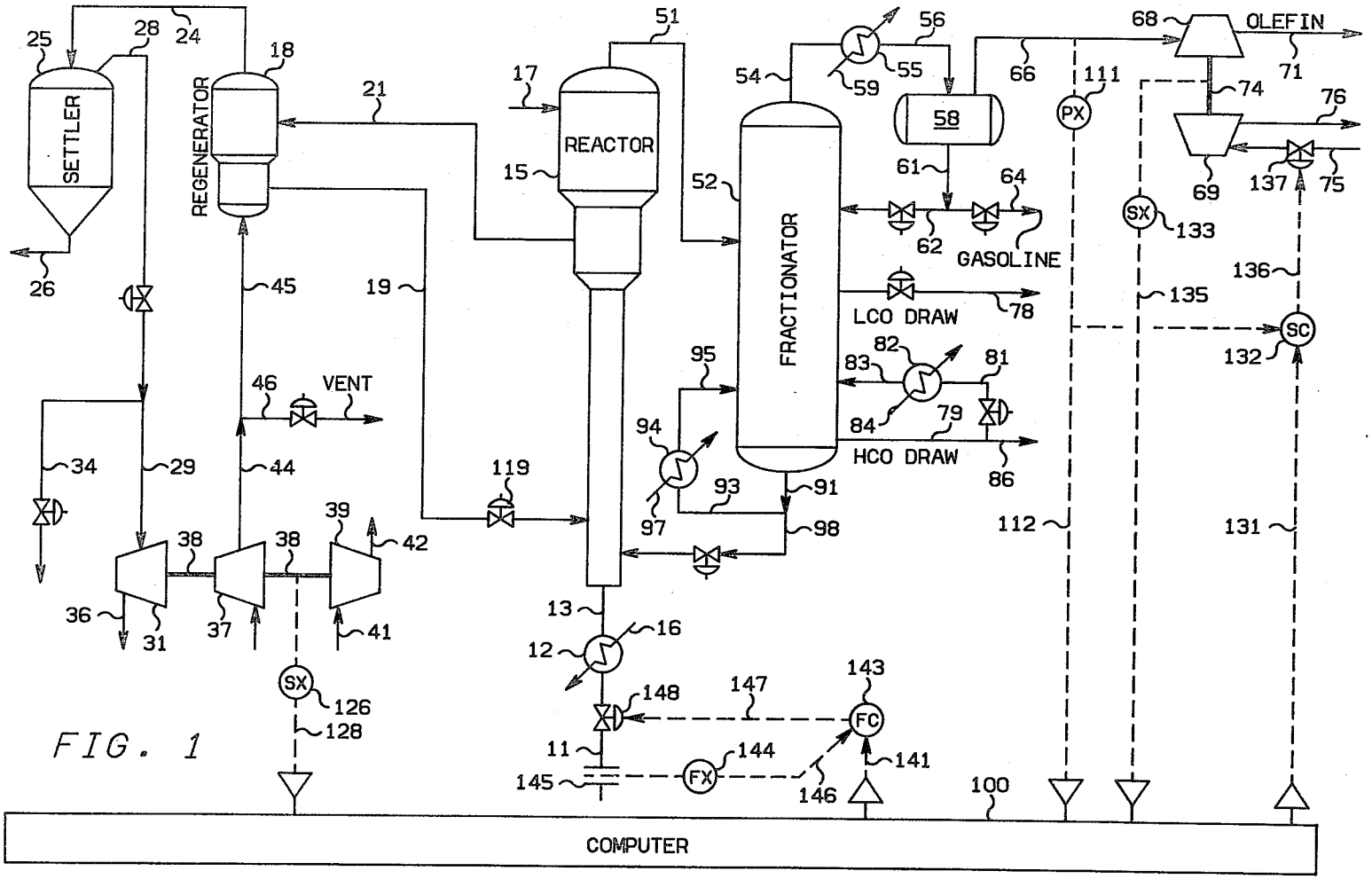

This invention relates to control of a fluid catalytic cracking unit (FCCU). In one aspect, this invention relates to method and apparatus for providing the capability to base load either the wet gas compressor or the air blower for the catalytic regenerator. In another aspect this invention relates to method and apparatus for shifting load to the device which is not base loaded. In still another aspect this invention relates to method and apparatus for manipulating the flow of feed to the FCCU so as to prevent an operating constraint on the wet gas compressor or air blower from being exceeded.

An FCCU is generally made up of a reactor, a catalyst regenerator and a fractionator plus associated equipment. An FCCU is commonly used to crack a feedstock, such as gas oil, into lighter products such as gasoline. As with any process, a primary objective of the operator is to maximize the production of a desired product while maintaining a low cost per unit volume of the desired product. This is especially true in an FCCU in which it is desirable to run as much feedstock through the reactor as possible while maintaining a desired conversion of the feedstock to a desired product so as to substantially maximize the production of the desired product.

As with any process, constraints are associated with an FCCU which may not be exceeded. Two of these constraints are the speed limitations on the wet gas compressor and the air blower for the catalytic regenerator. In general, as the flow of feed to the reactor is increased, the speed of the wet gas compressor and/or the air blower must be increased. It is thus an object of this invention to provide method and apparatus for manipulating the flow of feed to the FCCU so as to prevent an operating constraint on the wet gas compressor or the air blower for the catalytic regenerator from being exceeded if both the wet gas compressor and the air blower for the catalytic regenerator are operating at a maximum speed.

As used herein, the term "base loading" refers to loading either the wet gas compressor or the air blower to some maximum speed while the device which is not being base loaded to some maximum speed is maintained at at least a minimum period. In various FCCU's, it is often desirable to have the capability to base load either the wet gas compressor or the air blower. One device may be powered by steam while the other device is powered by electricity and thus it is desirable to base load the device which is operated by the cheaper power source. Also, process considerations and mechanical constraints for a particular FCCU may dictate that either the wet gas compressor or the air blower should be base loaded. It is thus an object of this invention to provide method and apparatus for providing the capability to base load either the wet gas compressor or the air blower for the catalytic regenerator.

After the wet gas compressor or air blower has been base loaded, it is desirable to be able to transfer additional loading which is caused by an increasing feed flow rate to the unit which was not base loaded. In this manner, the feed flow can be increased without exceeding an operating limitation on the unit which was base loaded. It is thus an object of this invention to provide method and apparatus for shifting load to the device which was not base loaded.

In accordance with the present invention, if the wet gas compressor is selected for base loading, a low suction pressure for the wet gas compressor is maintained as the flow of feed to the reactor is increased which causes the speed of the wet gas compressor to increase but allows the speed of the air blower to remain substantially at some selected low limit. When the wet gas compressor reaches a maximum speed, loading may be shifted to the air blower by allowing the suction pressure for the wet gas compressor to increase. The feed flow is not allowed to exceed a rate which would cause the speed limitation on the air blower to be exceeded when the wet gas compressor is base loaded.

Also in accordance with the present invention, if the air blower is selected for base loading, the suction pressure for the wet gas compressor is maintained at a high value which causes the speed of the air blower to increase while the speed of the wet gas compressor remains at a low value. If the air blower has been base loaded and the feed flow rate continues to increase then the suction pressure for the wet gas compressor may be allowed to drop which shifts load from the air blower to the wet gas compressor. The feed flow rate is not allowed to exceed a flow rate which would cause a speed limitation on the wet gas compressor to be exceeded if the air blower is selected for base loading.

Figure 2:
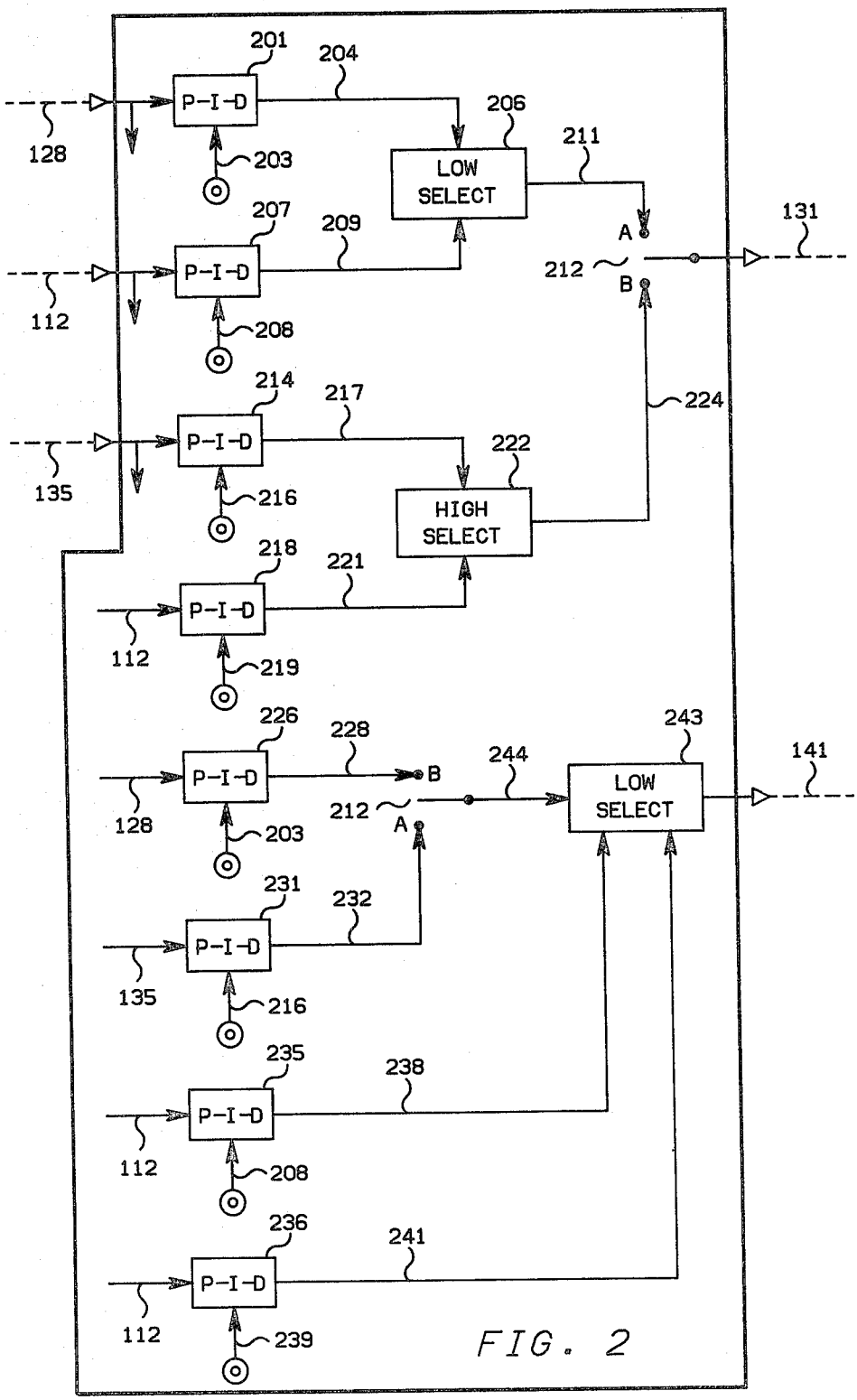

Other objects and advantages of the invention will be apparent from the foregoing brief description of the invention and the claims as well as the detailed description of the drawings in which:

FIG. 1 is a diagrammatic illustration of an FCCU with an associated control system; and FIG. 2 is a logic diagram of the preferred computer logic utilized to implement the desired control functions.

The invention is illustrated and described in terms of a particular FCCU configuration. However, the invention is also applicable to other FCCU configurations. The invention is also described in terms of an FCCU in which gas oil is utilized as a feedstock and the primary objective is to produce gasoline. However, other feedstocks may be utilized and the most desired product may be other than gasoline. The invention is also described in terms of supplying air to the regenerator to supply the oygen required to burn off carbon from the spent catalyst. Air is generally the fluid utilized to supply oxygen to the regenerator but any suitable fluid containing free oxygen may be utilized if desired.

Only those portions of the control system for an FCCU necessary to illustrate the present invention are set forth in FIG. 1. A large amount of additional control equipment will be utilized to control the FCCU but these additional control elements have not been illustrated for the sake of clarity in illustrating the present invention. Additional control elements required for an FCCU are well known from the many years that FCCU's have been utilized.

A specific control system configuration is set forth in FIG. 1 for the sake of illustration. However, the invention extends to different types of control system configurations which accomplish the purpose of the invention. Lines designated as signal lines in the drawings are electrical or pneumatic in this preferred embodiment. Generally, the signals provided from any transducer are electrical in form. However, the signals provided from flow sensors will generally be pneumatic in form. Transducing of these signals is not illustrated for the sake of simplicity because it is well known in the art that if a flow is measured in pneumatic form it must be transduced to electrical form if it is to be transmitted in electrical form by a flow transducer. Also, transducing of the signals from analog form to digital form or from digital form to analog form is not limited because such transducing is also well known in the art.

The invention is also applicable to mechanical, hydraulic or other signal means transmitting information. In almost all control systems some combination of electrical, pneumatic, mechanical or hydraulic signals will be used. However, use of any other type of signal transmission, compatible with the process and equipment in use, is within the scope of the invention.

A digital computer is used in the preferred embodiment of this invention to calculate the required control signals based on measured process parameters as well as set points supplied to the computer. Analog computers or other types of computing devices could also be used in the invention. The digital computer is preferably an OPTROL 7000 Process Computer System from Applied Automation, Inc., Bartlesville, Okla.

Signal lines are also utilized to represent the results of calculations carried out in a digital computer and the term "signal" is utilized to refer to such results. Thus, the term signal is used not only to refer to electrical currents or pneumatic pressures but is also used to refer to binary representations of a calculated or measured value.

Both the analog and digital controllers shown may utilize the various modes of control such as proportional, proportional-integral, proportional-derivative, or proportional-integral-derivative. In this preferred embodiment, proportional-integral-derivative controllers are utilized but any controller capable of accepting two input signals and producing a scaled output signal, representative of a comparison of the two input signals, is within the scope of the invention. The operation of proportional-integral-derivative controllers is well known in the art. The output control signal of a proportional-integral-derivative controller may be represented as $$S=K_1E+K_2\int Edt+K_3(dE/dt)$$

where

S=output control signal;

E=difference between two input signals; and $K_1$, $K_2$ and $K_3$=constants.

The scaling of an output signal by a controller is well known in control systems art. Essentially, the output of a controller may be scaled to represent any desired factor or variable. An example of this is where a desired flow rate and an actual flow rate is compared by a controller. The output could be a signal representative of a desired change in the flow rate of some gas necessary to make the desired and actual flows equal. On the other hand, the same output signal could be scaled to represent a percentage or could be scaled to represent a temperature change required to make the desired and actual flows equal. If the controller output can range from 0 to 10 volts, which is typical, then the output signal could be scaled so that an output signal having a voltage level of 5.0 volts corresponds to 50 percent, some specified flow rate, or some specified temperature.

The various transducing means used to measure parameters which characterize the process and the various signals generated thereby may take a variety of forms or formats. For example, the control elements of the system can be implemented using electrical analog, digital electronic, pneumatic, hydraulic, mechanical or other similar types of equipment or combinations of one or more of such equipment types. While the presently preferred embodiment of the invention preferably utilizes a combination of pneumatic final control elements in conjunction with electrical analog signal handling and translation apparatus, the apparatus and method of the invention can be implemented using a variety of specific equipment available to and understood by those skilled in the process control art. Likewise, the format of the various signals can be modified substantially in order to accommodate signal format requirements of the particular installation, safety factors, the physical characteristics of the measuring or control instruments and other similar factors. For example, a raw flow measurement signal produced by a differential pressure orifice flow meter would ordinarily exhibit a generally proportional relationship to the square of the actual flow rate. Other measuring instruments might produce a signal which is proportional to the measured parameter, and still other transducing means may produce a signal which bears a more complicated, but known, relationship to the measured parameter. Regardless of the signal format or the exact relationship of the signal to the parameter which it represents, each signal representative of a measured process parameter or representative of a desired process value will bear a relationship to the measured parameter or desired value which permits designation of a specific measured or desired value by a specific signal value. A signal which is representative of a process measurement or desired process value is therefore one from which the information regarding the measured or desired value can be readily retrieved regardless of the exact mathematical relationship between the signal units and the measured or desired process units.

Referring now to the drawings and in particular to FIG. 1, a gas oil feed is supplied through the combination of conduit means 11, heat exchanger 12 and conduit means 13 to the riser portion of the reactor 15. A heating fluid is supplied to the heat exchanger 12 through conduit means 16. Steam is supplied to the reactor 15 through conduit means 17.

A zeolite cracking catalyst is generally preferred for an FCCU but any suitable cracking catalyst may be utilized. Fresh catalyst is supplied from the catalyst regenerator 18 to the riser portion of the reactor 15 through conduit means 19. Spent catalyst is removed from the reactor 15 and is provided to the regenerator 18 through conduit means 21. Carbon is burned off of the spent catalyst in the regenerator 18 to produce the fresh catalyst which is provided through conduit means 19.

Hot flue gas is removed from the regenerator 18 and is provided through conduit means 24 to the settler 25. Fine particles are separated from the flue gas in the settler 25 and are removed through conduit means 26. Hot gases are removed from the settler 25 and are provided through the combination of conduit means 28 and 29 to the expander 31. The hot gases flowing through conduit means 28 may be bypassed around the expander 31 through conduit means 34. The hot gases flowing through conduit means 29 are removed from the expander 31 through conduit means 36. The hot gases are utilized to provide a driving force for the air blower 37 which is operably coupled to the expander 31 by means of shaft 38 which also extends through the air blower 37 to the steam turbine 39. Steam is provided to the turbine 39 through conduit means 41 and is removed through conduit means 42.

Ideally, the expander 31 is utilized to provide as much of the driving force required by the air blower 37 as possible. The turbine 39 is utilized only to supplement the expander 31.

Air is provided from the air blower 37 through the combination of conduit means 44 and 45 to the regenerator 18. Air may be vented through conduit means 46.

The reaction product is removed from the reactor 15 and is provided through conduit means 51 to the fractionator 52. The reaction product flowing through conduit means 51 will generally be made up of light olefins, gasoline, light cycle oil, heavy cycle oil and components of the feed which were not cracked in the reactor 15.

An overhead stream is withdrawn from the fractionator 52 and is provided through conduit means 54, heat exchanger 55 and conduit means 56 to the overhead accumulator 58. A cooling fluid is provided to the heat exchanger 55 through conduit means 59. A first portion of the liquid in the overhead accumulator 58 is withdrawn and is provided through the combination of conduit means 61 and 62 as an external reflux to the fractionator 52. A second portion of the liquid in the overhead accumulator 58 is provided through the combination of conduit means 61 and 64 as the gasoline product from the fractionator 52.

Vapor in the overhead accumulator 58 is withdrawn and is provided through conduit means 66 to the suction inlet of the compressor 68. The compressed vapors are provided from the discharge outlet of the compressor 68 through conduit means 71 to the primary absorber for an FCCU gas plant (not illustrated).

Power is provided to the compressor 68 from the turbine 69 which is operably connected to the compressor 68 through drive shaft 74. Steam is provided to the turbine 69 through conduit means 75 and is removed through conduit means 76.

A light cycle oil draw is removed from a central portion of the fractionator 52 through conduit means 78. A heavy cycle oil draw is removed from a lower portion of the fractionator 52 through conduit means 79. A portion of the heavy cycle oil draw flowing through conduit means 79 is recycled as a pumparound to the fractionator 52 through the combination of conduit means 81, heat exchanger 82 and conduit means 83. A cooling fluid is provided to the heat exchanger 82 through conduit means 84. The portion of the heavy cycle oil draw which is not recycled through conduit means 81 is removed as a product through conduit means 86.

A bottoms material is withdrawn from the fractionator 52 through conduit means 91. A portion of the thus withdrawn bottoms is recycled to the fractionator 52 through the combination of conduit means 93, heat exchanger 94 and conduit means 95. A cooling fluid is provided to the heat exchanger 94 through conduit means 97. The portion of the bottoms product flowing through conduit means 91, which is not recycled through conduit means 93, is provided through conduit means 98 to the riser portion of the reactor 15. It is noted that, in general, it is desirable to minimize the recycle of bottoms material to the riser reactor since the bottoms material flowing through conduit means 98 is very difficult to crack.

The FCCU described to this point is a conventional FCCU. Conventional equipment not required for an explanation of the invention has not been illustrated and described. Also, many of the process streams illustrated would be controlled by well known techniques but since these particular control configurations play no part in the explanation of the present invention, the standard control configurations are not described for the sake of simplicity.

A detailed description of the unique control system of the present invention follows. The control system will be described in terms of the process measurements required and the process control signals generated and then in terms of the manner in which the process control signals are generated in response to the process measurements.

Pressure transducer 11 in combination with a pressure sensing device, which is operably located in conduit means 66, provides an output signal 112 which is representative of the suction pressure for the wet gas compressor 68. Signal 112 is provided from the pressure transducer 111 as an input to computer means 100 and is also provided as the process variable input to the speed controller 132.

Speed transducer 133 in combination with a speed measuring device, which is operably associated with the drive shaft 74, provides an output signal 135 which is representative of the actual speed of the wet gas compressor 68. Signal 135 is provided from the speed transducer 133 an an input to computer means 100.

Speed transducer 126 in combination with a speed measuring device, which is operably associated with the drive shaft 38, provides an output signal 128 which is representative of the speed of the air blower 37. Signal 128 is provided from the speed transducer 126 as an input to computer means 100.

In response to the described process variable inputs and a number of set points and limits, which will be more fully described hereinafter, computer means 100 establishes two control signals which are utilized to implement the loading and load transfers previously described.

Signal 131 is representative of a desired suction pressure. Signal 131 is provided from computer means 100 as a set point input to the speed controller 132. In response to signals 131 and 112, the speed controller 132 provides an output signal 136 which is responsive to the difference between signals 131 and 112. Signal 136 is scaled so as to be representative of the opening of the control valve 137 required to maintain the actual suction pressure for the wet gas compressor 68, as represented by signal 112, substantially equal to the desired suction pressure for the wet gas compressor 68 as represented by signal 131. Signal 136 may be considered as being representative of the driving force which must be supplied to the wet gas compressor since a certain valve opening will provide a certain driving force. Signal 136 is provided from the speed controller 132 as a control signal to the control valve 137. The control valve 137 is manipulated in response to signal 136 to thereby maintain a control valve opening which will provide a required steam flow rate to the turbine 69.

Signal 141 is representative of the maximum allowable flow rate of the feed flowing through conduit means 11. Signal 141 is provided from computer means 100 as a set point input to the flow controller 143. Flow transducer 144 in combination with the flow sensor 145, which is operably located in conduit means 11, provides an output signal 146 which is representative of the actual flow rate of the feed flowing through conduit means 11. Signal 146 is provided from the flow transducer 144 as the process variable input to the flow controller 143. In response to signals 141 and 146, the flow controller 143 provides an output signal 147 which is representative of the opening of the control valve 148 which would allow the actual flow rate of the feed flowing through conduit means 11 to equal the maximum allowable feed flow rate as represented by signal 141. Signal 147 is provided from the flow controller 143 as a control signal to the control valve 148. The control valve 148 is manipulated in response to signal 147 to thereby maintain the opening of the control valve 148 substantially equal to an opening which will allow the actual feed flow rate to equal the maximum feed flow rate represented by signal 141.

The computer logic utilized to generate the described control signals in response to the described process variables supplied to the computer is illustrated in FIG. 2. The signals generated in the computer will be described first and then examples will be given of the manner in which the control system operates. Several of the process variable signals are utilized more than once in the computer logic and thus like numbers represent the same signals even though the signal lines may not be interconnected.

Referring now to FIG. 2, signal 128 which is representative of the actual speed of the air blower, is provided as a process variable input to the proportional-integral-derivative (P-I-D) controller block 201. The P-I-D controller block 201 is also provided with a set point signal 203 which is representative of a high limit on the speed of the air blower. The P-I-D controller block 201 provides an output signal 204 which is responsive to the difference between signals 128 and 203. Signal 204 is scaled so as to be representative of the maximum suction pressure for the wet gas compressor which may be attained without exceeding a limit on the speed of the air blower. Signal 204 is provided from the P-I-D controller block 201 as an input to the low select block 206.

Signal 112 which is representative of the actual suction pressure for the wet gas compressor is provided as the process variable input to the P-I-D controller block 207. The P-I-D controller block 207 is also provided with a set point signal 208 which is representative of a high limit for the wet gas compressor suction pressure. The P-I-D controller block 207 provides an output signal 209 which is responsive to the difference between signals 112 and 208. Signal 209 is scaled so as to be representative of the maximum suction pressure for the wet gas compressor which may be attained without exceeding a high limit on the suction pressure for the wet gas compressor. Signal 209 is provided from the P-I-D controller block 207 as a second input to the low select block 206.

It is noted that signal 208 could be supplied directly to the low select block 206 if desired. However, use of the P-I-D controller block provides a control action which helps to prevent the limit from being exceeded. Such action would not be available if signal 208 was supplied directly to the low select block 206.

The low select block 206 establishes an output signal 211 which is representative of the lower of signals 204 and 209. Signal 211 is supplied from the low select block 206 to terminal A of software switch 212.

Signal 135 which is representative of the speed of the wet gas compressor is provided as the process variabl input to the P-I-D controller block 214. The P-I-D controller block 214 is also provided with a set point signal 216 which is representative of a high limit for the speed of the wet gas compressor. The P-I-D controller block 214 provides an output signal 217 which is responsive to the difference between signals 135 and 216. Signal 217 is scaled so as to be representative of lowest suction pressure for the wet gas compressor which may be attained without exceeding a limit on the compressor speed. Signal 217 is provided from the P-I-D controller block 214 as an input to the high select block 222.

Signal 112, which is representative of the actual suction pressure for the wet gas compressor, is provided as a process variable input to the P-I-D controller block 218. The P-I-D controller block 218 is also provided with a set point signal 219 which is representative of a low limit for the suction pressure. The P-I-D controller block 218 provides an output signal 221 which is responsive to the difference between signals 112 and 219. Signal 221 is scaled so as to be representative of the minimum suction pressure for the wet gas compressor which may be attained without exceeding a low limit for the suction pressure. Signal 221 is provided from the P-I-D controller block 218 as an input to the high select block 222. Again, signal 219 could be provided directly to the high select block 222 if desired but the control action provided by the P-I-D controller block 218 would be lost.

The high select block 222 provides an output signal 224 which is representative of the higher of signals 217 and 221. Signal 224 is provided from the high select block 222 to terminal B of the software switch 212.

Depending upon the position of the software switch 212, signal 131 will be equal to either signal 211 or signal 224. Signal 131, which will be representative of a desired suction pressure for the wet gas compressor, is provided as an output from computer means 100 and is utilized as has been previously described.

Signal 128, which is representative of the actual speed of the air blower, is also provided as a process variable input to the P-I-D controller block 226. The P-I-D controller block 226 is also provided with set point signal 203 which is representative of a high limit for the air blower speed. The P-I-D controller block 226 provides an output signal 228 which is scaled so as to be representative of the maximum feed flow rate which may be attained without exceeding the high limit on the air blower speed. Signal 228 is provided to terminal B of the software switch 212 which is the same software switch as the software switch previously described.

Signal 135, which is representative of the speed of the wet gas compressor, is provided as a process variable input to the P-I-D controller block 231. The P-I-D controller block 231 is also provided with a set point signal 216 which is representative of a high limit for the wet gas compressor speed. The P-I-D controller block 231 provides an output signal 232 which is responsive to the difference between signals 135 and 216. Signal 232 is scaled so as to be representative of the maximum feed flow rate which may be attained without exceeding a high limit on the wet gas compressor speed. Signal 232 is provided from the P-I-D controller block 231 to terminal A of the software switch 212.

Signal 112, which is representative of the actual suction pressure for the wet gas compressor, is provided as an input to the P-I-D controller blocks 235 and 236. The P-I-D controller block 235 is also provided with a set point signal 208 which is representative of a high limit for the suction pressure. The P-I-D controller block 235 provides an output signal 238 which is responsive to the difference between signals 112 and 208. Signal 238 is scaled so as to be representative of the maximum feed flow rate which may be attained without exceeding a high limit on the suction pressure.

The P-I-D controller block 236 is also provided with a set point signal 239 which is representative of a low limit for the suction pressure. The P-I-D controller block 236 provides an output signal 241 which is responsive to the difference between signals 112 and 239 and which is scaled so as to be representative of a maximum desired feed flow rate which may be attained without exceeding a low limit on the suction pressure. Signal 241 is provided from the P-I-D controller block 236 as an input to the low select block 243. The low select block 243 is also provided with signal 244 which is representative of either signal 228 or signal 232 depending upon the position of the switch 212.

The low select block 243 provides the output control signal 141 which is representative of the lower of signals 144, 238 and 241. Signal 141 is provided as a control signal from computer means 100 and is utilized as has been previously described.

The position of the software switch 212 is selected by an operator. Assuming that process considerations make it desirable to base load the air blower, position A will be selected. The P-I-D controller block 201 will seek to force the air blower speed to increase to the high limit for the air blower speed. This is accomplished by forcing the suction pressure for the wet gas compressor to increase and thus signal 204 will slowly cause the suction pressure to increase by slowing down the wet gas compressor. The P-I-D controller block 207 is provided as a safety feature to prevent a high limit for the wet gas compressor suction pressure from being exceeded. Such a high limit may be determined by metallurgical constraints or other process considerations. Thus, in general, signal 204 will be provided as signal 131 when the software switch 212 is in position A. signal 209 is provided as signal 131 only if the suction pressure begins to exceed a high limit for the suction pressure. Initially signal 131 will force the speed of the wet gas compressor to be reduced which results in increasing the load on the air blower.

At the same time, the P-I-D controller block 231 will be seeking to increase the feed rate because the wet gas compressor speed will be considerably below its high limit. The P-I-D controller blocks 235 and 236 are utilized to prevent the feed rate from causing the suction pressure to exceed a high or low limit. Thus, with the software switch in position A, signal 232 will generally be provided as the output control signal 141. Only under circumstances in which the feed rate is causing the suction pressure to exceed a high or low limit will signals 238 or 241 be provided as signal 141. Initially signal 141 will seek to increase the feed rate.

As the feed rate is increased, more gas is supplied through conduit means 66 to the wet gas compressor. This causes the suction pressure to increase and this increased suction pressure is reflected through the FCCU to the catalyst regenerator 18. Thus, the air blower has to operate at a higher speed to pump sufficient air to the regenerator 18 to regenerate the catalyst. When the air blower speed reaches the high limit set point (which indicates that base loading has been completed), the output signal 204, which is being provided as the control signal 131, will begin to force the suction pressure to decrease. As the suction pressure represented by signal 31 decreases, the speed of the wet gas compressor must be increased in order for the actual suction pressure to remain substantially equal to the suction pressure represented by signal 131. Effectively, loading is being transferred to the wet gas compressor.

As the feed rate continues to increase, loading will continue to be transferred to the wet gas compressor until such time as the high limit for the speed of the wet gas compressor is reached. At such a time, the P-I-D controller block 231 will prevent the feed rate from increasing any further because any increase in feed rate would cause either the wet gas compressor or the air blower to be overdriven.

In summary, if position A of the software switch is selected, the feed rate will slowly be forced to increase while the speed of the wet gas compressor is held at some low level which will cause the air blower to become loaded because of the high pressure in the FCCU. When the air blower becomes loaded, the speed of the wet gas compressor will be increased as the feed rate continues to increase. Only when both the wet gas compressor and air blower are completely loaded will the increases in the flow of feed be terminated. Thus, the FCCU will be operating at a maximum feed flow rate without violating process constraints which substantially maximizes the profitability of the FCCU.

Assuming that process considerations dictate that it would be desirable to base load the wet gas compressor, the operator sets the software switch to position B. The P-I-D controller block 214 will seek to force the speed of the wet gas compressor to increase. Thus, the output signal 217 will be representative of a low suction pressure since a low suction pressure will cause the wet gas compressor to have to operate at a higher speed. The P-I-D controller block 218 is provided as a safety factor to prevent a low limit for the suction pressure from being exceeded. Thus, with the software switch 212 in position B, signal 217 will generally be provided as the control signal 131. Signal 131 will cause the speed of the wet gas compressor to be increased to maintain the actual suction pressure substantially equal to the suction pressure represented by signal 131.

At the same time, the P-I-D controller 226 will be forcing the feed rate to increase since the low FCCU pressure will allow the air blower to operate at a low speed. Again, signals 238 and 241 are utilized to prevent suction pressure constraints from being exceeded. In general, signal 228 will be provided as the control signal 141 when the software switch 212 is in position B.

As the flow rate of the feed slowly increases, the wet gas compressor will reach its high limit (indicating that the wet gas compressor has been base loaded). At this point signal 217, which is being provided as signal 131, will begin to represent an increasing suction pressure. This will cause the speed of the air blower to be increased while the speed of the wet gas compressor remains at the high limit because of the increasing feed rate. When the air blower reaches a speed high limit, the P-I-D controller block 226 will force the increases in the feed rate to be terminated. The flow of feed will then be maintained at a rate which completely loads the wet gas compressor and the air blower.

In summary, if it is desired to base load the wet gas compressor, the software switch is set to position B. Controller 226 forces the feed rate to increase slowly.

Controller 214 forces the speed of the wet gas compressor to increase to maintain a low suction pressure as the feed rate increases. When the wet gas compressor speed reaches a high limit, load is shifted to the air blower until such time as the air blower is also loaded. When both the wet gas compressor and air blower are loaded, increases in the feed rate are terminated and the FCCU will be operating at a desired condition of maximum feed rate without violating a process constraint.

Although the objective is always to operate at maximum feed flow rate, it will be necessary on occasion to back feed out of the reactor after the maximum feed rate has been achieved (when the air blower and gas compressor are both loaded at a given set of operating conditions). An example of this would be if there was a significant rise in ambient temperature, such as after a rainstorm or going from night to daytime operation. As the ambient temperature increases, the air blower would pump the same volume of air as long as the blower speed has not changed, but there are now fewer pounds (mass) of air because of the density change due to the change in ambient temperature. The control scheme described herein would "back out" just enough feed to satisfy the constraint that was violated with the switch in either position A or position B.

The invention has been described in terms of a preferred embodiment as illustrated in FIGS. 1 and 2. Specific control components which can be used in the practice of the invention as illustrated in FIG. 1 such as pressure transducer 111; speed transducers 133 and 126; speed controller 132; flow transducer 144; flow controller 143; and the many control valves illustrated are each well known, commercially available control components such as are illustrated and described at length in Perry's *Chemical Engineer's Handbook,* 4th Edition, Chapter 22, McGraw-Hill.

While the invention has been described in terms of the presently preferred embodiment, reasonable variations and modifications are possible by those skilled in the art and such variations and modifications are within the scope of the described invention and the appended claims.

That which is claimed is:

1. Apparatus comprising:

a reactor;

a catalyst regenerator;

a fractionator;

means for supplying a feed to said reactor;

means for supplying a regenerated cracking catalyst from said catalyst regenerator to said reactor;

means for removing cracking catalyst contaminated by carbon from said reactor and for supplying the thus removed cracking catalyst to said catalyst regenerator;

air blower means for supplying a free oxygen-containing gas to said regenerator;

means for removing hot flue gases from said catalyst regenerator;

means for removing the products produced by the cracking of said feed from said reactor and for supplying the thus removed products as a feed to said fractionator;

cooling means;

accumulator means;

means for withdrawing an overhead stream from said fractionator and for supplying the thus withdrawn overhead stream through said cooling means to said accumulator means;

a compressor;

means for withdrawing uncondensed vapors from said accumulator means and for supplying the thus withdrawn uncondensed vapors to the suction inlet of said compressor;

means for establishing a first signal representative of the actual speed of said air blower means;

means for establishing a second signal representative of the highest desired speed for said air blower means;

means for comparing said first signal and said second signal and for establishing a third signal which is representative of a first desired suction pressure for said compressor;

means for manipulating the speed of said compressor in response to said third signal;

means for establishing a fourth signal representative of the actual speed of said compressor;

means for establishing a fifth signal representative of the highest desired speed for said compressor;

means for comparing said fourth signal and said fifth signal and for establishing a sixth signal which is representative of a first feed flow rate; and means for manipulating the flow of feed to said reactor in response to said sixth signal.

2. Apparatus in accordance with claim 1 additionally comprising:

means for establishing a seventh signal representative of the actual suction pressure for said compressor;

means for establishing an eighth signal representative of the highest desired suction pressure for said compressor;

means for comparing said seventh signal and said eighth signal and for establishing a ninth signal responsive to the difference between said seventh signal and said eighth signal, wherein said ninth signal is representative of a second desired suction pressure; and means for manipulating the speed of said compressor in response to said ninth signal if the magnitude of said ninth signal is less than the magnitude of said third signal.

3. Apparatus in accordance with claim 2 wherein said means for manipulating the speed of said compressor in response to said third signal or said ninth signal if the magnitude of said ninth signal is greater than the magnitude of said third signal comprises:

low select means;

means for supplying said third signal and said ninth signal to said low select means, wherein the lower of said third and ninth signals is provided as a tenth signal from said low select means;

means for comparing said tenth signal and said seventh signal and for establishing an eleventh signal responsive to the difference between said seventh signal and said tenth signal, wherein said eleventh signal is scaled so as to be representative of the driving force which must be supplied to said compressor to maintain the actual suction pressure for said compressor substantially equal to the desired suction pressure for said compressor; and means for manipulating the driving force supplied to said compressor in response to said eleventh signal.

4. Apparatus in accordance with claim 1 additionally comprising:

means for establishing a seventh signal representative of the actual suction pressure for said compressor;

means for establishing an eighth signal representative of the highest desired suction pressure for said compressor;

means for comparing said seventh signal and said eighth signal and for establishing a ninth signal responsive to the difference between said seventh signal and said eighth signal, wherein said ninth signal is scaled so as to be representative of a second feed flow rate;

means for establishing a tenth signal representative of the lowest desired suction pressure for said compressor;

means for comparing said seventh signal and said tenth signal and for establishing an eleventh signal which is responsive to the difference between said seventh signal and said tenth signal, wherein said eleventh signal is scaled so as to be representative of a third feed flow rate;

means for manipulating the flow of feed to said reactor in response to the lower of said ninth and eleventh signals if the lower of said ninth and eleventh signals is lower than said sixth signal.

5. Apparatus in accordance with claim 4 wherein said means for manipulating the flow of feed to said reactor in response to the lower of said sixth, ninth and eleventh signals comprises:

a control valve operably located in said means for supplying feed to said reactor;

a low select means;

means for supplying said sixth signal, said ninth signal and said eleventh signal to said low select means, wherein the lower of said sixth, ninth and eleventh signals is provided as a twelfth signal from said low select means;

means for establishing a thirteenth signal representative of the actual feed flow rate;

means for comparing said twelfth signal and said thirteenth signal and for establishing a fourteenth signal responsive to the difference between said twelfth signal and said thirteenth signal, wherein said fourteenth signal is scaled so as to be representative of the position of said control valve means required to maintain said twelfth signal substantially equal to said thirteenth signal; and means for manipulating said control valve in response to said fourteenth signal.

6. Apparatus comprising:

a reactor;

a catalyst regenerator;

a fractionator;

means for supplying a feed to said reactor;

means for supplying a regenerated cracking catalyst from said catalyst regenerator to said reactor;

means for removing cracking catalyst contaminated by carbon from said reactor and for supplying the thus removed cracking catalyst to said catalyst regenerator;

air blower means for supplying a free oxygen-containing gas to said regenerator;

means for removing hot flue gases from said catalyst regenerator;

means for removing the products produced by the cracking of said feed from said reactor and for supplying the thus removed products as a feed to said fractionator;

cooling means;

accumulator means;

means for withdrawing an overhead stream from said fractionator and for supplying the thus withdrawn overhead stream through said cooling means to said accumulator means;

a compressor;

means for withdrawing uncondensed vapors from said accumulator means and for supplying the thus withdrawn uncondensed vapors to the suction inlet of said compressor;

means for establishing a first signal representative of the actual speed of said compressor;

means for establishing a second signal representative of the highest desired speed for said compressor;

means for comparing said first signal and said second signal and for establishing a third signal which is representative of a first desired suction pressure for said compressor;

means for manipulating the speed of said compressor in response to said third signal;

means for establishing a fourth signal representative of the actual speed of said air blower means;

means for establishing a fifth signal representative of the highest desired speed for said air blower means;

means for comparing said fourth signal and said fifth signal and for establishing a sixth signal which is representative of a first feed flow rate; and means for manipulating the flow of feed to said reactor in response to said sixth signal.

7. Apparatus in accordance with claim 6 additionally comprising:

means for establishing a seventh signal representative of the actual suction pressure for said compressor;

means for establishing an eighth signal representative of the lowest desired suction pressure for said compressor;

means for comparing said seventh signal and said eighth signal and for establishing a ninth signal responsive to the difference between said seventh signal and said eighth signal, wherein said ninth signal is representative of a second desired suction pressure; and means for manipulating the speed of said compressor in response to said ninth signal if the magnitude of said ninth signal is less than the magnitude of said third signal.

8. Apparatus in accordance with claim 7 wherein said means for manipulating the speed of said compressor in response to said third signal or said ninth signal if the magnitude of said ninth signal is greater than the magnitude of said third signal comprises:

high select means;

means for supplying said third signal and said ninth signal to said high select means, wherein the higher of said third and ninth signals is provided as a tenth signal from said high select means;

means for comparing said tenth signal and said seventh signal and for establishing an eleventh signal responsive to the difference between said seventh signal and said tenth signal, wherein said eleventh signal is scaled so as to be representative of the driving force which must be supplied to said compressor to maintain the actual suction pressure for said compressor substantially equal to the desired suction pressure for said compressor; and means for manipulating the driving force supplied to said compressor in response to said eleventh signal.

9. Apparatus in accordance with claim 6 additionally comprising:

means for establishing a seventh signal representative of the actual suction pressure for said compressor;

means for establishing an eighth signal representative of the highest desired suction pressure for said compressor;

means for comparing said seventh signal and said eighth signal and for establishing a ninth signal responsive to the difference between said seventh signal and said eighth signal, wherein said ninth signal is scaled so as to be representative of a second feed flow rate;

means for establishing a tenth signal representative of the lowest desired suction pressure for said compressor;

means for comparing said seventh signal and said tenth signal and for establishing an eleventh signal which is responsive to the difference between said seventh signal and said tenth signal, wherein said eleventh signal is scaled so as to be representative of a third feed flow rate; and means for manipulating the flow of feed to said reactor in response to the lower of said ninth and eleventh signals if the lower of said ninth and eleventh signals is lower than said sixth signal.

10. Apparatus in accordance with claim 9 wherein said means for manipulating the flow of feed to said reactor in response to the lower of said sixth, ninth and eleventh signals comprises:

a control valve operably located in said means for supplying feed to said reactor;

a low select means;

means for supplying said sixth signal, said ninth signal and said eleventh signal to said low select means, wherein the lower of said sixth, ninth and eleventh signals is provided as a twelfth signal from said low select means;

means for establishing a thirteenth signal representative of the actual feed flow rate;

means for comparing said twelfth signal and said thirteenth signal and for establishing a fourteenth signal responsive to the difference between said twelfth signal and said thirteenth signal, wherein said fourteenth signal is scaled so as to be representative of the position of said control valve means required to maintain said twelfth signal substantially equal to said thirteenth signal; and means for manipulating said control valve in response to said fourteenth signal.

11. A method for controlling a fluid catalytic cracking unit, wherein a feed provided to a reactor is contacted with a regenerated cracking catalyst provided to the reactor from a catalyst regenerator to produce a product stream which is provided from said reactor to a fractionator, wherein cracking catalyst contaminated by carbon is provided from said reactor to said catalyst regenerator and contacted with a free oxygen-containing gas provided to said catalyst regenerator from an air blower to produce said regenerated catalyst with the resulting hot gases being removed from said catalyst regenerator as a flue gas, and wherein an overhead stream is withdrawn from said fractionator and partially condensed with the uncondensed portion of said overhead stream being provided to the suction inlet of a compressor, said method comprising the steps of:

selecting said air blower for base loading;

establishing a first signal representative of the actual speed of said air blower;

establishing a second signal representative of the highest desired speed for said air blower;

comparing said first signal and said second signal and establishing a third signal which is representative of a first desired suction pressure for said compressor;

manipulating the speed of said compressor in response to said third signal;

establishing a fourth signal representative of the actual speed of said compressor;

establishing a fifth signal representative of the highest desired speed for said compressor;

comparing said fourth signal and said fifth signal and establishing a sixth signal which is representative of a first feed flow rate; and manipulating the flow of feed to said reactor in response to said sixth signal.

12. A method in accordance with claim 11 additionally comprising the steps of:

establishing a seventh signal representative of the actual suction pressure for said compressor;

establishing an eighth signal representative of the highest desired suction pressure for said compressor;

comparing said seventh signal and said eighth signal and establishing a ninth signal responsive to the difference between said seventh signal and said eighth signal, wherein said ninth signal is representative of a second desired suction pressure; and manipulating the speed of said compressor in response to said ninth signal if the magnitude of said ninth signal is less than the magnitude of said third signal.

13. A method in accordance with claim 12 wherein said step of manipulating the speed of said compressor in response to said third signal or said ninth signal if the magnitude of said ninth signal is greater than the magnitude of said third signal comprises:

establishing a tenth signal which is equal to the lower of said third and ninth signals;

comparing said tenth signal and said seventh signal and establishing an eleventh signal responsive to the difference between said seventh signal and said tenth signal, wherein said eleventh signal is scaled so as to be representative of the driving force which must be supplied to said compressor to maintain the actual suction pressure for said compressor substantially equal to the desired suction pressure for said compressor; and manipulating the driving force supplied to said compressor in response to said eleventh signal.

14. A method in accordance with claim 11 additionally comprising the steps of:

establishing a seventh signal representative of the actual suction pressure for said compressor;

establishing an eighth signal representative of the highest desired suction pressure for said compressor;

comparing said seventh signal and said eighth signal and establishing a ninth signal responsive to the difference between said seventh signal and said eighth signal, wherein said ninth signal is scaled so as to be representative of a second feed flow rate;

establishing a tenth signal representative of the lowest desire suction pressure for said compressor;

comparing said seventh signal and said tenth signal and establishing an eleventh signal which is responsive to the difference between said seventh signal and said tenth signal, wherein said eleventh signal is scaled so as to be representative of a third feed flow rate;

manipulating the flow of feed to said reactor in response to the lower of said ninth and eleventh signals if the lower of said ninth and eleventh signals is lower than said sixth signal.

15. A method in accordance with claim 14 wherein said step of manipulating the flow of feed to said reactor in response to the lower of said sixth, ninth and eleventh signals comprises:

establishing a twelfth signal representative of the lower of said sixth, ninth and eleventh signals;

establishing a thirteenth signal representative of the actual feed flow rate;

comparing said twelfth signal and said thirteenth signal and establishing a fourteenth signal responsive to the difference between said twelfth signal and said thirteenth signal, wherein said fourteenth signal is scaled so as to be representative of the position of a control valve, used to control the flow of said feed, required to maintain said twelfth signal substantially equal to said thirteenth signal; and manipulating said control valve in response to said fourteenth signal.

16. A method for controlling a fluid catalytic cracking unit, wherein a feed provided to a reactor is contacted with a regenerated cracking catalyst provided to the reactor from a catalyst regenerator to produce a product stream which is provided from said reactor to a fractionator, wherein cracking catalyst contaminated by carbon is provided from said reactor to said catalyst regenerator and contacted with a free oxygen-containing gas provided to said catalyst regenerator from an air blower to produce said regenerated catalyst with the resulting hot gases being removed from said catalyst regenerator as a flue gas, and wherein an overhead stream is withdrawn from said fractionator and partially condensed with the uncondensed portion of said overhead stream being provided to the suction inlet of a compressor, said method comprising the steps of:

selecting said compressor for base loading;

establishing a first signal representative of the actual speed of said compressor;

establishing a second signal representative of the highest desired speed for said compressor;

comparing said first signal and said second signal and establishing a third signal which is representative of a first desired suction pressure for said compressor;

manipulating the speed of said compressor in response to said third signal;

establishing a fourth signal representative of the actual speed of said air blower;

establishing a fifth signal representative of the highest desired speed for said air blower;

comparing said fourth signal and said fifth signal and establishing a sixth signal which is representative of a first feed flow rate; and manipulating the flow of feed to said reactor in response to said sixth signal.

17. A method in accordance with claim 16 additionally comprising the steps of:

establishing a seventh signal representative of the actual suction pressure for said compressor;

establishing an eighth signal representative of the lowest desired suction pressure for said compressor;

comparing said seventh signal and said eighth signal and establishing a ninth signal responsive to the difference between said seventh signal and said eighth signal, wherein said ninth signal is representative of a second desired suction pressure; and manipulating the speed of said compressor in response to said ninth signal if the magnitude of said ninth signal is less than the magnitude of said third signal.

18. A method in accordance with claim 17 wherein said step of manipulating the speed of said compressor in response to said third signal or said ninth signal if the magnitude of said ninth signal is greater than the magnitude of said third signal comprises:

establishing a tenth signal which is equal to the higher of said third and ninth signals;

comparing said tenth signal and said seventh signal and establishing an eleventh signal responsive to the difference between said seventh signal and said tenth signal, wherein said eleventh signal is scaled so as to be representative of the driving force which must be supplied to said compressor to maintain the actual suction pressure for said compressor substantially equal to the desired suction pressure for said compressor; and manipulating the driving force supplied to said compressor in response to said eleventh signal.

19. A method in accordance with claim 16 additionally comprising the steps of:

establishing a seventh signal representative of the actual suction pressure for said compressor;

establishing an eighth signal representative of the highest desired suction pressure for said compressor;

comparing said seventh signal and said eighth signal and establishing a ninth signal responsive to the difference between said seventh signal and said eighth signal, wherein said ninth signal is scaled so as to be representative of a second feed flow rate;

establishing a tenth signal representative of the lowest desired suction pressure for said compressor;

comparing said seventh signal and said tenth signal and establishing an eleventh signal which is responsive to the difference between said seventh signal and said tenth signal, wherein said eleventh signal is scaled so as to be representative of a third feed flow rate;

manipulating the flow of feed to said reactor in response to the lower of said ninth and eleventh signals if the lower of said ninth and eleventh signals is lower than said sixth signal.

20. A method in accordance with claim 19 wherein said step of manipulating the flow of feed to said reactor in response to the lower of said sixth, ninth and eleventh signals comprises:

establishing a twelfth signal representative of the lower of said sixth, ninth and eleventh signals;

establishing a thirteenth signal representative of the actual feed flow rate;

comparing said twelfth signal and said thirteenth signal and establishing a fourteenth signal responsive to the difference between said twelfth signal and said thirteenth signal, wherein said fourteenth signal is scaled so as to be representative of the position of a control valve, used to control the flow of said feed, required to maintain said twelfth signal substantially equal to said thirteenth signal; and manipulating said control valve in response to said fourteenth signal.

* * * * *